United States Patent [19]

Kapanen et al.

[11] 4,038,162

[45] July 26, 1977

[54] METHOD AND APPARATUS FOR DETECTING AND ELIMINATING SHORT-CIRCUITS IN AN ELECTROLYTIC TANK

[75] Inventors: Aarne Albin Kapanen, Espoo; Pentti Jaakkima Rautimo, Helsinki, both of Finland

[73] Assignee: Outokumpu Oy, Helsinki, Finland

[21] Appl. No.: 672,662

[22] Filed: Apr. 1, 1976

[30] Foreign Application Priority Data

Apr. 10, 1975 Finland ..... 751086

[51] Int. Cl.[2] ..... C25C 1/00; C25C 7/06

[52] U.S. Cl. ..... 204/105 R; 204/225; 204/228

[58] Field of Search ..... 204/225, 226, 228, 106, 204/105 R

[56] References Cited

U.S. PATENT DOCUMENTS

| | | | |
|---|---|---|---|
| 679,357 | 7/1901 | Betts | 204/226 |
| 1,996,342 | 4/1935 | McGregor | 204/225 |
| 2,897,129 | 7/1959 | Dilling | 204/225 |
| 3,574,073 | 4/1971 | Ralston, Jr. | 204/228 |
| 3,944,995 | 3/1976 | Kobayashi | 204/225 |

*Primary Examiner*—T. M. Tufariello

*Attorney, Agent, or Firm*—Brooks, Haidt, Haffner & Delahunty

[57] ABSTRACT

In an electrolytic tank wherein cathode sheets and anode plates are arranged alternately close to each other and wherein the cathode sheets are attached to cathode bars being in contact with current rails of the tank, there is provided a method and a device for detecting and eliminating short-circuits between cathodes and anodes, in which method and apparatus the total current of each cathode bar is determined by measuring a current dependent quantity, such as the magnetic field, the temperature or similar, thereof, a short-circuit condition is recognized if the determined current exceeds a predetermined value, and, whenever such short-circuit is thus detected, the cathode sheet in question is replaced with a fresh cathode sheet by a device which is movable along rails or similar above the cathode/anode row and which is provided with a fork member or similar for lifting the defect sheet and for lowering the new sheet to replace the one removed. Preferably the detecting means comprises a row of gaussmeters attached to a common bar extending along the row of cathodes/anodes. The replacing device may comprise a movable carriage and the operation thereof is preferably controlled automatically by a programmed control unit.

11 Claims, 3 Drawing Figures

METHOD AND APPARATUS FOR DETECTING AND ELIMINATING SHORT-CIRCUITS IN AN ELECTROLYTIC TANK

BACKGROUND OF THE INVENTION

1. Field of the Invention

The present invention relates to a method and device for detecting and eliminating short-circuits in an electrolytic tank in which anode plates and cathode sheets have been immersed in a row alternately, close to each other, and wherein the total current of a cathode is determined by observing the magnetic field, temperature, or some other suitable quantity produced by the current of the cathode bar attached to the cathode sheet and being in contact with a conductor rail of the tank, in order to detect a possible short-circuit condition.

Although the invention can be applied in connection with any metal electrolysis, the description below relates to its application to copper electrolysis.

2. Description of the Prior Art

The electrolytic refining of copper is known to be performed as follows: crude copper anodes and cathode sheets, which serve as starting sheets on both sides of which pure copper will deposit, have been immersed alternately in rows in a flowing electrolyte, which can be a copper sulfate solution containing sulfuric acid. The anodes and the cathodes rest on conductor rails, the anodes supported by their lugs and the cathodes by transversal cathode bars from which the sheets have been suspended.

In order to produce effective precipitation and to save power consumption the anodes and cathodes must be rather close to each other, and, further more, the copper deposit may grow exceptionally rapidly at some points, and therefore short-circuit conditions are often created between the anodes an the cathodes in the tank. Another natural reason for this is that the starting sheets in particular curve easily, or a sheet may not be positioned properly halfway between adjacent plates.

Short-circuit condition here denotes a state deviating from the normal, in which case the total current of a cathode surpasses a certain, predetermined limit value. Naturally, if a short-circuit is created through, for example, a "bridge" growing between the anodes and the cathodes, the strength of the current increases gradually until it produces a strong short-circuit, and the change in the condition is thus not sudden.

The following methods are known for finding short circuits:

a. measuring of the voltage of an individual cathode bar over a predetermined length
b. magnetic measuring of an individual cathode bar by means of a gaussmeter
c. measuring of the temperature by means of an infrared camera and reading the temperature map of the tank.

Thus, these methods are based on the fact that an exceptionally strong current causes respectively (a) a greater voltage loss per length unit of the bar, (b) a stronger magnetic field around the bar, and (c) a higher temperature in the bar.

All these measuring methods are, however, capable of only locating the defective cathodes, which is only one-fifth of the work caused by short-circuits. Marking and repairing the defect have been manual so far.

For example, when using a gaussmeter the work has been performed as follows: the person performing the measuring walks along the cathode row and tests the current of each cathode bar by means of the gaussmeter measuring head. The meter has preferably a "red area" which indicates a field stronger than normal, i.e., a short-circuit condition. If one appears, the location of the cathode is marked by, for example, chalk or a piece of tape, and the sheet is repaired shortly after the measuring.

The repairing may be performed by simply moving the sheet: usually it is, however, necessary to lift the sheet up, remove the short-circuit bridges (protuberances) and straighten the sheet. Since a cathode weighs approx. 20–100 kg, depending on how far the depositing has progressed, the repair work is cumbersome and requires two persons. In addition, the walking on top of the tank during the measuring and repairing may cause new short-circuits.

Another known method is to lift all the cathodes from the tank after a couple of days' electrolysis, to straighten them in a press, and to reimmerse them in the electrolyte. In this case it is possible to keep the sheet straight since the metal deposits on their both sides increase their stiffness. Naturally, however, such an operation requires high-capacity lifting devices and presses, and a great deal of wasted work is performed since during the growth period of the cathodes (7–14 days) only a few percent of the sheets are short-circuited.

SUMMARY OF THE INVENTION

The present invention provides a method of the character described, which comprises determining the total current of a cathode by observing a suitable current-depending quantity, such as the magnetic field, the temperature or similar, of the cathode bar; recognizing a short-circuit condition when the determind cathode current exceeds a predetermined value; upon the detection of a short-circuit condition, directing an automatic cathode-replacing device, movable along the cathode/anode row, to the position of the detected short-circuit condition and stopping it above said position; lifting up the short-circuit cathode and moving it away, and lowering a new cathode sheet to replace the one removed.

Preferably the automatic cathode-replacing device is controlled by a central control unit of known type, such as a digital data processor, which receives signals from the measuring heads and controls the operation of the replacing-device in accordance with said signals.

The invention also provides an apparatus for carrying out the method described, said apparatus comprising detecting means positioned at each cathode bar in order to measure a current-dependent quantity, such as the magnetic field, the temperature or similar, thereof; a cathode-replacing device movable along the row of cathode sheets and anode plates; lifting and lowering means in said cathode-replacing device for lifting and removing a cathode sheet whenever an excess current is detected in the cathode bar and for lowering a new cathode starting sheet to replace the removed one; and means for controlling the operation of said cathode-replacing device in accordance with the detected currents of the cathode bars.

DESCRIPTION OF THE PREFERRED EMBODIMENT

Figure 1:
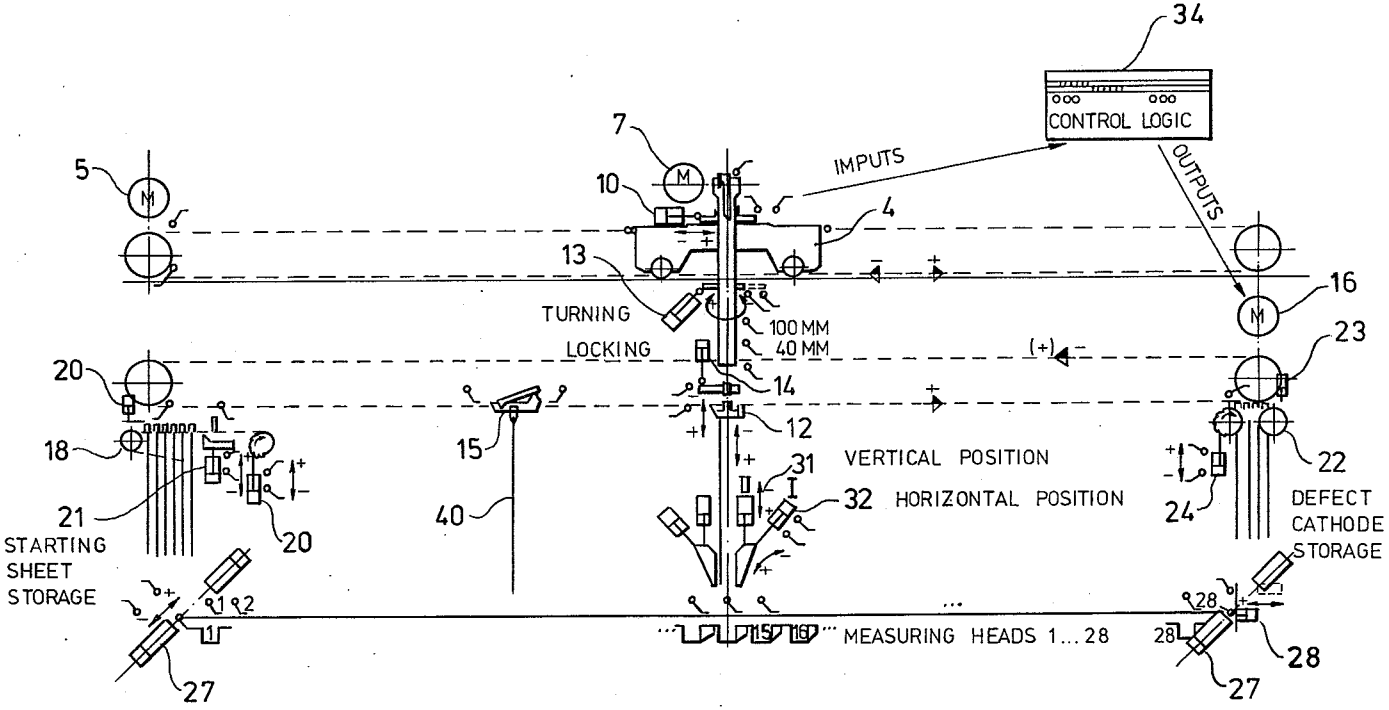
FIG. 1 depicts schematically a side view of a device according to the invention, and its operation principle.

The defect-detecting and cathode-replacing device shown in the figures has been shown as movable along the rails 1, in which case it is either hoisted from one tank to another or the rails have been set up so that the device can move over all the tanks without being hoisted. A steel-framed trestle 2 serves as the frame of the replacing device (FIG. 2), and all the other operating members are attached to it.

In the figures the anode plates are indicated by 41 and the cathode sheets by 40. In the illustrated example there are 28 detectors 25, which have been attached to the same transferring beam 26. There is one transferring beam on each side of the device so that the device need not be turned when the total-current heads of the cathode bars 39 are on the other side. Number 38 indicates the conductor rails extending along the tank edge.

Figure 2:
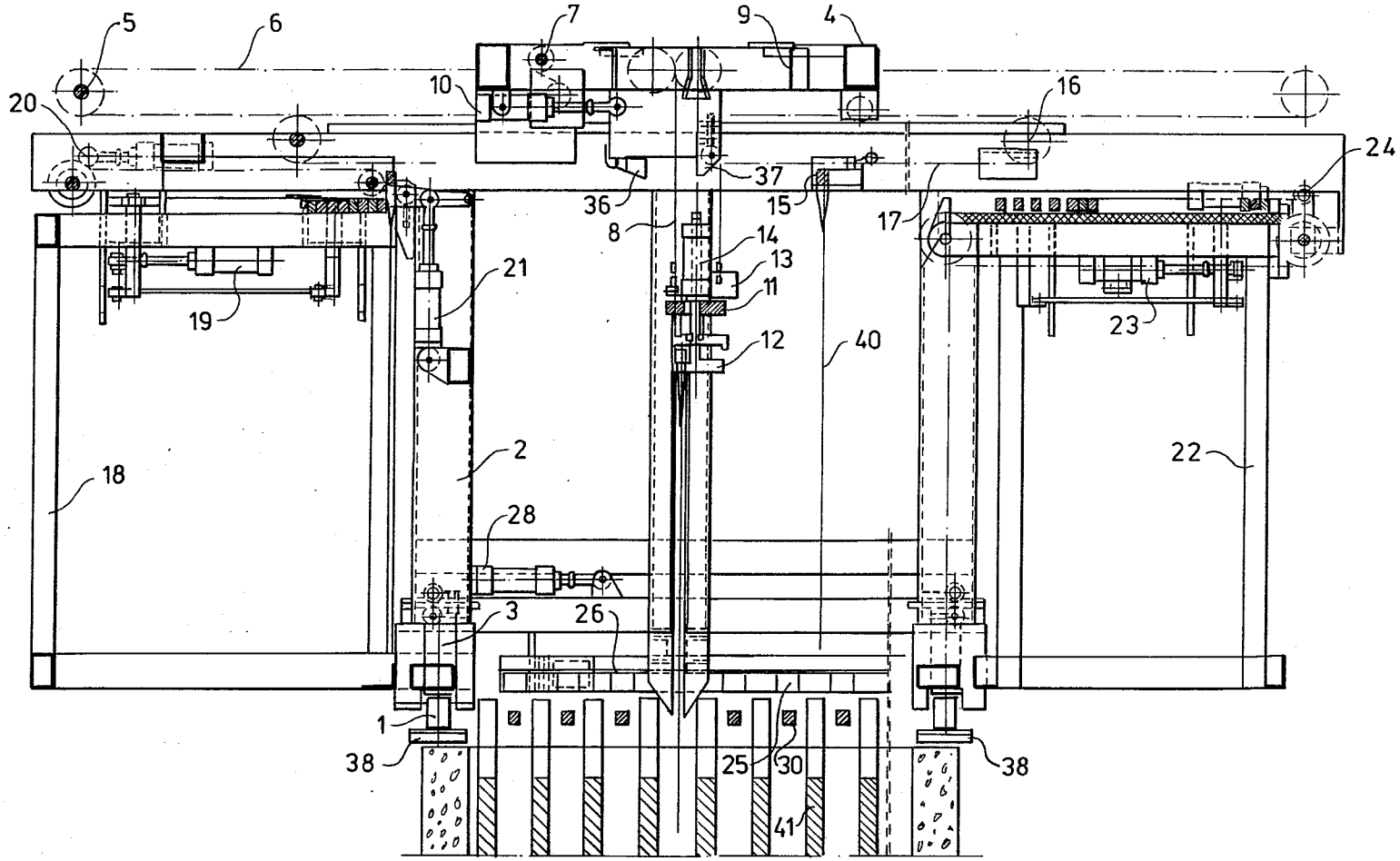
FIG. 2 depicts a side view of an embodiment of the device according to the invention, partially as a cross-section.
Figure 3:
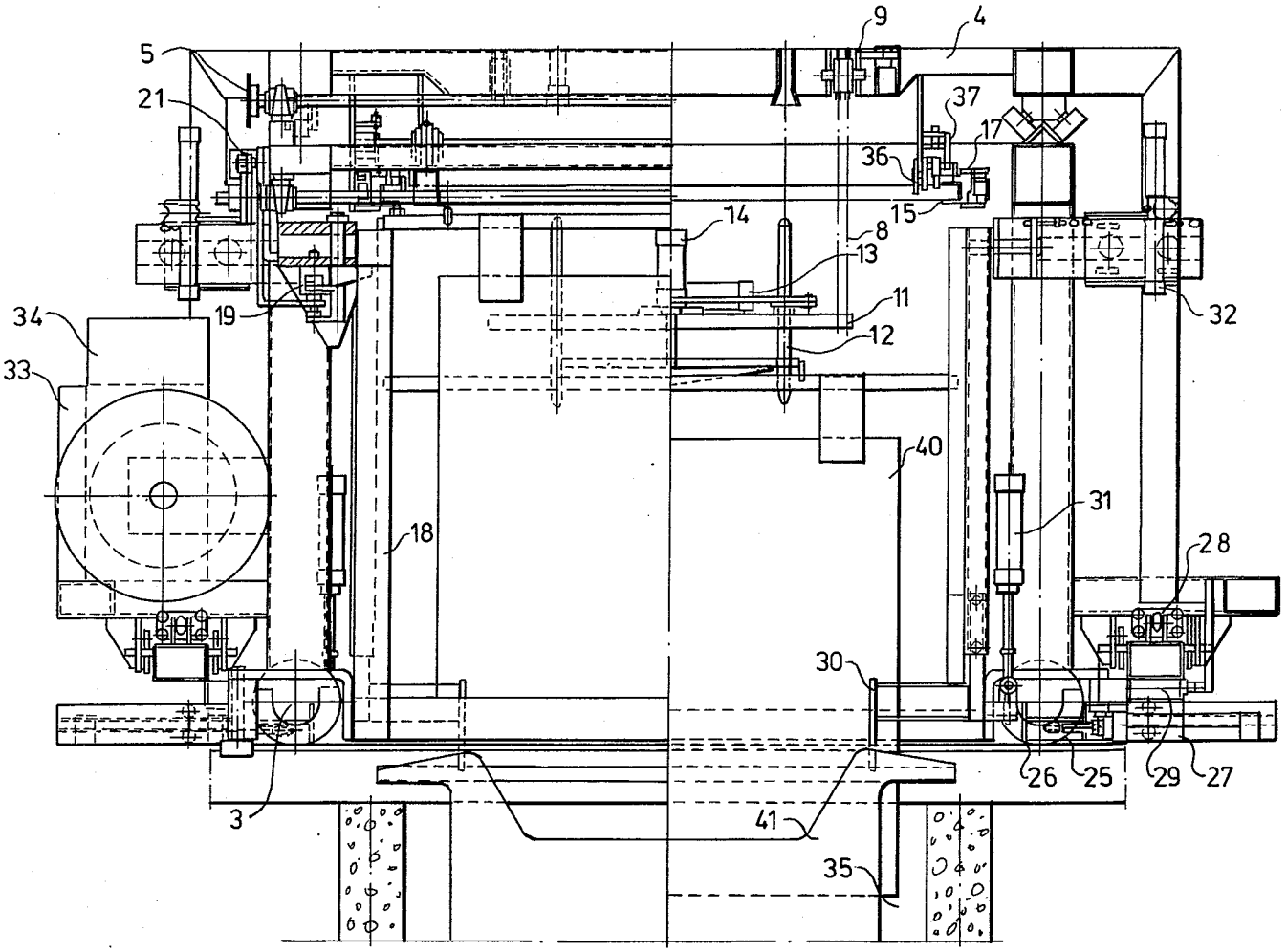
FIG. 3 depicts an end view of the same device.

Referring to FIGS. 1–2, the storage cage 18 for new cathode sheets or starting sheets is seen on the left and the storage cage 22 for the removed cathodes, on the right. Between them extend the beams along which the forked carriage 4 can be moved by the transferring mechanism 5 and the chain 6.

The other parts of the device are described below together with its operation.

By means of the transferring mechanism 3 the device has been moved in the transversal direction to above the tank 35 and the desired row of sheets.

The forked carriage 4 is in its basic position at the end closest to the starting-sheet storage cage 18.

The forked beam 11 is in its upper position.

The beams 26 for transferring the short-circuit detectors 25 are in their back position.

The starting-sheet guides 30 are in their back position.

The conveyor 15 is in its basic position at the end closest to the starting-sheet storage cage.

The hydraulic mechanism 33 produces the pressurized oil required by the motors and the cylinders.

The replacing device receives all operation orders from the control center 34, either automatically or by manual control.

Current is connected to the replacing devices control center.

An empty cathode storage cage 22 is brought in place, the locking is performed by means of the cylinders 23.

A storage cage 18 is filled with starting sheets is brought in place, the locking is effected by means of the cylinders 19.

OPERATION

The control switch is pressed and the detector-transferring beams 26 move to the operation position.

There are two transferring beams, one on each side of the carriage, and the transfer is effected by means of hydraulic cylinders 27, of which there are four.

The control cylinder 28 moves the beam 26 so that the first detector arrives at the first cathode.

The short-circuit detectors 25 (28 of them per one transferring beam) register a short-circuit and transmit the information to the limit switches 29 and light the signal on the panel in the control center 24. The transferrring beams 26 move to the back position. The signal light is on until all the defective cathodes have been replaced.

The limit switches 29 give a departure order to the forked carriage 4 and stop it at the defective cathode.

The transferring mechanism 5 of the forked carriage consists of a chain 6 driven by an electric or a hydraulic motor.

The forked beam 11 supported by the chains 8 is lowered.

The lifting and lowering mechanism 7 is either an electric or a hydraulic motor.

The turning cylinder 13 turns the forks 12 to the lifting position. The lifting mechanism 7 lifts a defective cathode up. After the defective cathode has been lifted approximately 40 mm the cylinder 14 locks the cathode between the fork 12 and the locking plate 37.

The cylinder 21 for batching the starting sheets moves a starting sheet to the upper position and gives an impulse to the conveyor 15. p The driving mechanism 16 of the conveyor chains 17 of the conveyor is either an electric or a hydraulic motor.

The conveyor picks a starting sheet, conveys it, delivers it to the forks, takes a defective cathode to the storage cage 22, and thereafter returns to its basic position.

The bolt 36 prevents the starting sheet from falling off the fork. After the conveyor has given an impulse the batching cylinder 21 returns to its lower position and the starting-sheet feeding mechanism 20 and the cathode feeding mechanism 24 transfer the storage chains one notch forward.

The fork-locking cylinder 14 locks the starting sheet.

The transferring cylinder 10 moves the forked carriage 9 so that the starting sheet arrives at the location from where a cathode has been removed.

The starting-sheet guides 30 are moved to the front position by the transferring cylinder 32. Thereafter the lower ends of the guides are pushed down to between the anodes by the cylinder 31.

The forked beam 11 descends to such a position that the ends of the starting-sheet bar are in the grooves of the guide 30 and the starting sheet is guided into its place. Approximately 100 mm before the lower position the cylinder 14 releases the locking. At the lower position the turning cylinder 13 turns the forks to the side position. The forked beam 11 rises, the transferring cylinder 10 moves it to the basic position. The guides 30 move to the back position.

If there are several short-circuits in the same tank, the operation is as described above. If there are no short-circuits the forked carriage 4 returns to its basic position.

The operation proceeds to the next tank, etc.

As was described above, devices measuring the voltage losses at the anodes can be attached to the transferring beam 26 of the cathode-replacing device, and these measuring devices can be used for measuring and registering the voltage loss between an anode and the conductor rail.

The following applies especially to the lifting and lowering mechanism for the sheets. The lifting and the lowering could naturally be performed by means of a long-movement vertical cylinder as well, but this would increase the height of the device considerably. In the described embodiment the lifting and lowering mechanism does not increase the height of the device and the control of the sheet during the lowering is ensured by vertical guides 30, in the grooves of which the ends of the cathode bar move. Since the locations of the anode plates can vary somewhat, it is expedient to open the locking of the guiding somewhat before it reaches the lower position and to allow the guides to "seek" the final position of the cathode sheet midway between the anode plates. Turning the hooks of the forks around a vertical axis to the gripping position and to the detaching position, which is effected by means of the turning cylinder 13, is necessary in order that the forks could be lowered respectively lifted through the narrow clearance between the anode and the cathode.

What is claimed is:

1. A method for detecting and eliminating short-circuits in an electrolytic tank in which anode plates and cathode sheets have been immersed alternately at predetermined intervals, each cathode sheet being connected to a cathode bar which is in contact with a conductor rail of the tank, said method comprising determining the total current of a cathode by observing a suitable current-depending quantity, such as the magnetic field, the temperature or similar, of the cathode bar, recognizing a short-circuit condition when the determined cathode current exceeds a predetermined value, upon the detection of a short-circuit condition, and responsive thereto, directing an automatic cathode-replacing device, movable along the cathode/anode row, to the position of the detecting short-circuit condition and stopping it above said position, lifting up the short-circuit cathode and moving it away, and lowering a new cathode sheet to replace the one removed.

2. A method according to claim 1, wherein the current of a cathode bar is observed by measuring, with a gaussmeter, the strength of the magnetic field produced around it, and one measuring head is provided for each cathode bar and the measuring heads of an entire row of cathode sheets are reciprocated together, each over its respective cathode bar, in order to find the maximum value of the magnetic field.

3. A method according to claim 2, wherein the signals given by the measuring heads are directed to a central control unit, which, on the basis of the signals received, controls the operation of the cathode-replacing device.

4. An apparatus for detecting and eliminating short-circuits in an electrolytic tank of the type where anode plates and cathode sheets have been immersed alternately, close to each other, each cathode sheet being attached to a cathode bar and the cathode bars resting on current rail of the tank, said device comprising detecting means positioned at each cathode bar in order to measure a current-dependent quantity, such as the magnetic field, the temperature or similar, thereof, a cathode-replacing device movable along the row of cathode sheets and anode plates, lifting and lowering means in said cathode-replacing device for lifting and removing a cathode sheet whenever an excess current is detected in the cathode bar for lowering a new cathode starting sheet to replace the removed one, and means for controlling the operation of said cathode-replacing device in accordance with the detected currents of the cathode bars.

5. An apparatus according to claim 4, which comprises a carriage moving along rails above the electrolytic tank and being provided with said lifting and lowering means, a starting-sheet storage, and a storage for removed cathode sheets.

6. An apparatus according to claim 5, further comprising conveying means which grip the bar of a starting sheet and convey the sheet from the storage to the said carriage and take the lifted cathode sheet which has been short-circuited to the storage for removed cathodes.

7. An apparatus according to claim 5, wherein the carriage has forks provided with lifting and lowering mechanisms, and at the lower end of the forks there are hooks for gripping the cathode sheet, the forks being furthermore turnable for inserting the hooks between the cathodes and the anodes.

8. An apparatus according to claim 4, wherein the cathode-replacing device comprises vertical guides along which the ends of the cathode bar move during the lowering in order to guide the starting sheet to its proper position.

9. A device according to claim 8, wherein the guides are movable in the vertical direction and releasable from their direction locking somewhat before they reach their lower position, and the lower ends of the guides are wedge-shaped for seeking the right lowering position between the anode plates.

10. A device according to claim 4, wherein the detecting means comprises successively arranged magnetic detectors, such as gaussmeter measuring heads for measuring the magnetic fields of all the cathode sheets simultaneously.

11. A device according to claim 10, wherein the measuring heads have been fitted to a common beam extending along the cathode row and being provided with means for its reciprocation.

* * * * *

UNITED STATES PATENT AND TRADEMARK OFFICE

CERTIFICATE OF CORRECTION

PATENT NO. : 4,038,162

DATED : July 26, 1977

INVENTOR(S) : Aarne Albin Kapanen et al

It is certified that error appears in the above-identified patent and that said Letters Patent are hereby corrected as shown below:

Col. 5, Line 33

"detecting" should be --detected--

Col. 6, Line 12

"bar for lowering" should be --bar and for lowering--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*